US008011126B2

(12) United States Patent
Nunez et al.

(10) Patent No.: US 8,011,126 B2
(45) Date of Patent: Sep. 6, 2011

(54) PRICE AND INFORMATION TAG CONSTRUCTION

(75) Inventors: Chris E. Nunez, Ada, MI (US); Dennis M. Kucharczyk, Grand Rapids, MI (US)

(73) Assignee: Grandville Printing Company, Grandville, MI (US)

( * ) Notice: Subject to any disclaimer, the term of this patent is extended or adjusted under 35 U.S.C. 154(b) by 242 days.

(21) Appl. No.: 12/390,604

(22) Filed: Feb. 23, 2009

(65) Prior Publication Data

US 2010/0212195 A1 Aug. 26, 2010

(51) Int. Cl.
*G09F 3/20* (2006.01)

(52) U.S. Cl. ..... 40/658; 40/661.03; 40/672

(58) Field of Classification Search ..... 40/658, 40/661.03, 642.02, 650, 661.08, 672
See application file for complete search history.

(56) References Cited

U.S. PATENT DOCUMENTS

| | | | | |
|---|---|---|---|---|
| 1,315,892 | A | | 9/1919 | Wilson |
| 1,757,964 | A | | 5/1930 | Hurst |
| 1,904,457 | A | | 4/1933 | Healy |
| 2,720,044 | A | | 10/1955 | Montalto |
| 2,755,576 | A | | 7/1956 | Golden |
| 2,882,625 | A | | 4/1959 | Hopp |
| 2,984,031 | A | | 5/1961 | Giesecke |
| 3,290,809 | A | | 12/1966 | King |
| 3,753,305 | A | | 8/1973 | Mueh |
| 4,070,778 | A | * | 1/1978 | Mahler et al. ..... 40/124.11 |
| 4,167,073 | A | * | 9/1979 | Tang ..... 40/661.03 |
| 5,205,591 | A | * | 4/1993 | Lorenz ..... 283/117 |
| 5,419,066 | A | * | 5/1995 | Harnois et al. ..... 40/661.03 |
| 5,458,282 | A | * | 10/1995 | Martin ..... 229/92.8 |
| 6,408,553 | B1 | | 6/2002 | Brown et al. |
| 6,817,127 | B2 | | 11/2004 | Gottlieb et al. |
| 2003/0070332 | A1 | * | 4/2003 | Santa Cruz et al. ..... 40/124.01 |
| 2005/0022437 | A1 | * | 2/2005 | Gottlieb et al. ..... 40/661.03 |
| 2005/0126060 | A1 | | 6/2005 | Rawlings et al. |
| 2006/0010743 | A1 | * | 1/2006 | Fowler et al. ..... 40/638 |
| 2006/0236568 | A1 | * | 10/2006 | Switzer et al. ..... 40/124.11 |
| 2007/0246532 | A1 | | 10/2007 | Nunez et al. |

* cited by examiner

*Primary Examiner* — Gary C Hoge
(74) *Attorney, Agent, or Firm* — Price Heneveld LLP

(57) ABSTRACT

A price-and-information tag includes front and rear surfaces both having product and price information. The tag includes a pre-fold line and a perforated line dividing the sheet into spaced-apart first and second sections. When bi-folded, the first section fits into an upwardly-open pocket of an extruded tag holder, with the second section in front of the tag holder and hiding the first section. Further, the second section can be torn off along the perforated line to reveal the information on the first section with minimal labor. A picture on the tag allows a non-reading installer to place the tag. Methods related to same are also shown, including double folding the elongated sheet and then using the first section to engage a tag holder with only the information on the second section being visible, the second section being later torn off to reveal the information on the first section.

23 Claims, 4 Drawing Sheets

PRICE AND INFORMATION TAG CONSTRUCTION

BACKGROUND

The present invention relates to tag constructions attached to store shelves to provide price and product information about product on the store shelves, and more particularly relates to a price-and-information tag construction particularly configured for labor-efficient and secure placement on a display shelf.

The industry of printing price-and-information tags is highly specialized. This is because hundreds of thousands of tags must be produced and shipped each week to large retail stores for placement on shelves, and further because last minute price fluctuations, price decisions, and information changes result in a huge amount of data that is difficult to manage without error. Further, data shows that attractive and colorful price-and-information tags can positively affect customer decisions and increase sale volumes. On the other hand, inaccurate information and mispricing can cause customer confusion, dissatisfaction, adverse publicity, and even liability where the posted pricing doesn't match sales prices at the cash register.

Large retail stores often identify shelved product with price tags removably attached to a channel or extrusion tag holder extending along the shelves. One particular widely-used tag holder is extruded of resilient transparent plastic material in a shape for attachment to the narrow front edge of a store shelf. The extruded tag holder includes parallel panels forming an upwardly open pocket for receiving a first (rear-positioned) price-and-information tag, and further includes opposing flanges defining a narrow throat for engaging a top of a second (front-positioned) price-and-information tag to position the second tag in a hanging position in front of the first tag. This positions the second tag over the first tag where it can be used for advertising a "SALE" or discounted sale price, both printed on the second tag. Sometimes, only a front tag is attached, and the upwardly-open pocket is left unfilled. A problem is that the front tag can be accidentally knocked off of the tag holder (or knocked to an out-of-location position) by customers removing product from the shelf. This problem often becomes worse over time as the opposing flanges of the extruded tag holder weaken and/or wear and/or deform to a more spread position. Still another problem is that the front tag can be knocked to an offset position where the rear tag is visible, confusing customers, as well as creating a poor disheveled appearance unattractive for displayed product.

Another problem is the amount of manual labor for placement and replacement of the price-and-information tags. Every time there is a price change, such as when a sale ends, the first tag must be removed and another tag put in place. This results in substantial labor costs, both because of difficulty in accessing, gripping and removing the first tag, and also because of the time it takes to recognize a proper placement location for a tag. It is important to understand that the act of removing and replacing a tag only takes a few seconds, however when that time is multiplied by hundreds of thousands of tags, and further when the complexity and opportunity for error is increased by logistics based on the size of stores (and their different product locations and arrangements), the costs become very significant.

Yet another problem is that tags must be manually put in place, and the person placing the tag must read the tag and pay attention to where the tag must go. This has been partially solved by the concept of a patent application filed earlier than the present filing, where a digital press and software is used to arrange tags in the order of particular store shelf sequences. However, the opportunity remains for improvement to better utilize unskilled labor when placing price tags.

Another concern is cost and quality of tags. It is important that pricing-and-information tags be very attractive, clear, accurate, and provided on a just-in-time basis. A process and apparatus for providing competitive and highly-attractive price-and-information tags is disclosed in co-assigned application Ser. No. 11/612,821, filed Dec. 19, 2006, entitled METHOD OF PRINTING, DISTRIBUTING, AND PLACING PRICE INFORMATION. The entire contents of that application are incorporated herein in its entirety. However, further improvement is desired in terms of security of attachment of the tag to a shelf, ease of placement and removal, flexible use, and competitive low cost, while maintaining a high level of attractiveness for consumers.

SUMMARY OF THE PRESENT INVENTION

In one aspect of the present invention, a price-and-information system has a transparent tag holder defining an upwardly open pocket for receiving a price-and-information tag. The tag holder is adapted for attachment to the front of a display shelf. An improvement in the tag includes an elongated sheet with front and rear surfaces. Product and price information is printed on both the front and rear surfaces. An attachment structure is included for releasably engaging the upwardly open pocket of the tag holder with a portion of the product and price information on the front surface being visible, and the tag being folded so that the product and price information on the rear surface faces forward but is hidden by a part of the sheet.

In a narrower aspect, the sheet includes first and second sections, the attachment structure being formed on the first section. A perforated line separates the first and second sections. The first section further includes a pre-formed fold line for spacing the second section forward from the first section so that the second section extends downward in front of a tag holder and in front of information on the first section. The perforated line provides accurately separating the second section from the first section so that the information on the first section is visible.

In another aspect of the present invention, a price-and-information tag includes an elongated sheet having front and rear surfaces, and also having first and second sections separated by a fold line, with product and price information printed on both the front and rear surfaces of the first section. The sheet is folded so that a portion of the sheet covers a portion of the information.

In another aspect of the present invention, a method of placing price-and-information tags includes steps of providing an elongated sheet having front and rear surfaces with product and price information printed on both the front and rear surfaces. A tag holder is provided on a shelf front. The method still further includes folding the sheet to form a first section with first information thereon hidden behind a second section with second information thereon. The sheet is attached to the tag holder with the second information visible, but the first information not visible. The second section is torn off to expose the first information.

In another aspect of the present invention, a method of placing price-and-information tags includes steps of providing an elongated sheet having front and rear surfaces with product and price information printed on both the front and rear surfaces. The method further includes double folding the elongated sheet to form a first vertical section separated from a second vertical section by a horizontal strip region. The first vertical section is extended into an upwardly-open pocket of a tag holder such that the sheet is securely held by the tag holder with the product and price information on the second vertical section is visible in front of the tag holder, with the product and price information of the first vertical section hidden behind the second vertical section.

In a narrower aspect of the present invention, a perforated line is provided on the elongated sheet separating the first and second sections, and includes a step of tearing along the perforated line to remove the second section from the first section, with the first section remaining on the tag holder.

An object of the present invention is to provide a price-and-information tag that can be securely attached to a shelf using existing tag holders, with ease of placement and removal, while maintaining flexible use, while maintaining a competitive (low) cost, and while maintaining attractiveness to consumers.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
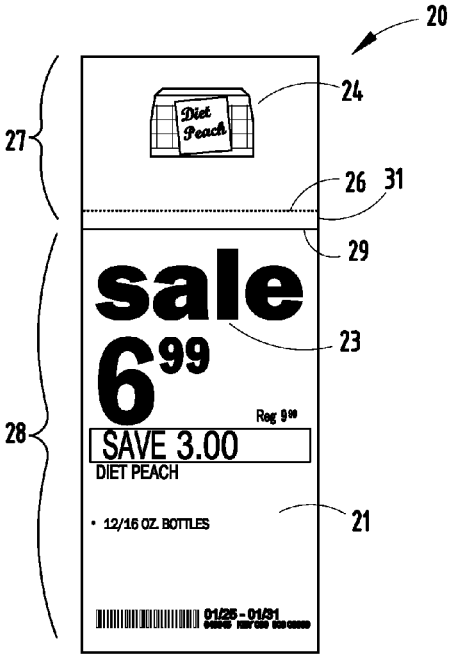
FIGS. 1-2 are front and rear views of a price-and-information tag embodying the present invention.
Figure 2:
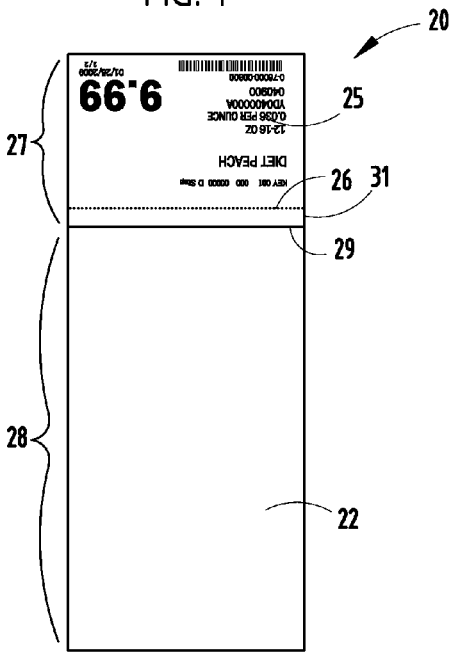
Figure 3:
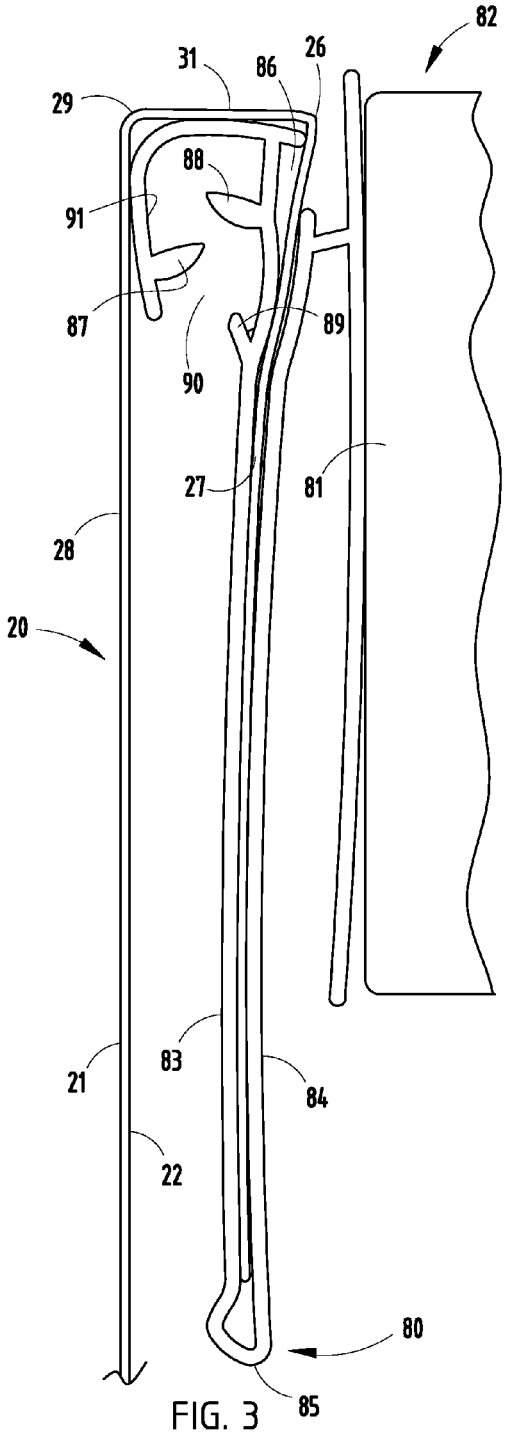
FIGS. 3-4 are enlarged side and front views of the tag in FIG. 1 as bi-folded and installed on an extruded tag holder attached to a front of a shelf.
Figure 9:
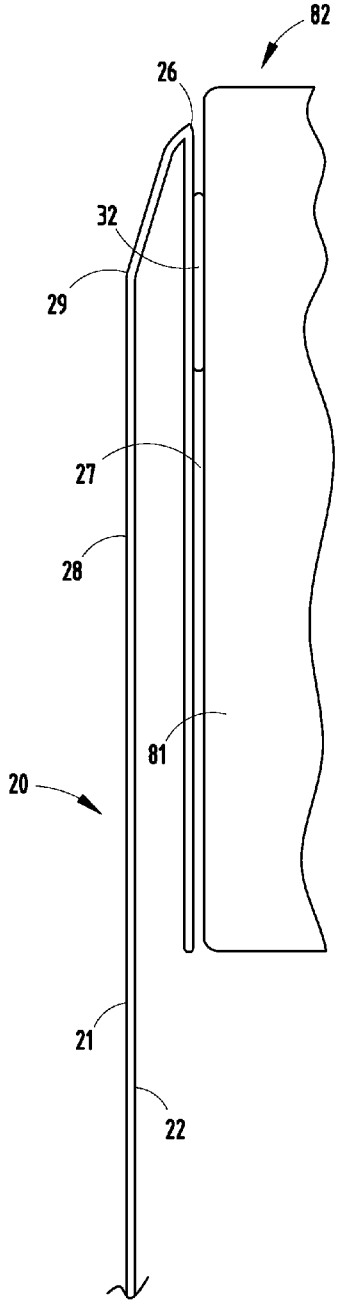
FIG. 9 is an enlarged side view showing the tag of FIG. 7 bi-folded and adhesively attached to a shelf front.

The present price-and-information tag 20 (FIGS. 1-2) comprises an elongated sheet having front and rear surfaces 21 and 22 with product and price information 23 and 24 printed on the front surface 21, and additional product and price information 25 printed on the rear surface 22. A perforated line 26 (i.e., a line of "perforations") divides the sheet into first and second sections 27 and 28. Notably, the perforated line 26 also acts as a fold line. A pre-formed second fold line 29 is formed on the second section 27 at a location spaced from the perforated line 26 to define a strip region 31 next to the perforated line 26. When double folded along lines 26 and 29, the first section 27 forms an attachment structure as discussed below. (See FIG. 3.) It is contemplated that tag 20 can optionally include a strip of adhesive 32 placed on the first section 27 near the perforated line 26 to provide an alternative (secondary) attachment structure for attaching the tag 20 to a shelf front, such as when an extruded tag holder is not present. (See FIG. 9.)

Figure 4:
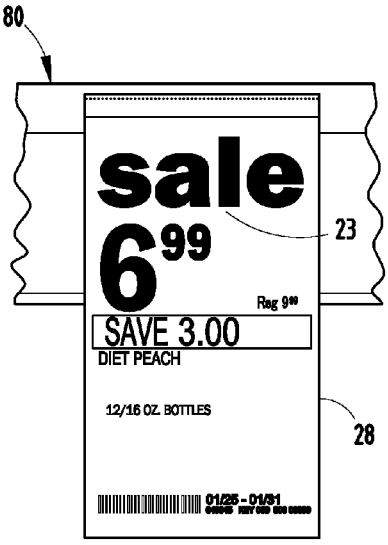

The present tag 20 (FIGS. 3-4) is particularly designed for use on an existing extruded tag holder 80 made of transparent plastic material and attached to a front 81 of a shelf 82. The extruded tag holder 80 includes front and rear vertical panels 83 and 84 connected by bottom strip 85 to form an upwardly-open pocket 86 for receiving a price-and-information tag. Historically, the pocket 86 receives a first single-thickness card-like tag with price and product information on one side. The tag holder 80 further includes opposing flanges 87, 88, 89 defining a downwardly-opening throat 90 for frictionally engaging a top edge of a second single-thickness card-like tag with price and product information on one side. The purpose of the flanges 87-89 is to hold a tag in front of the holder 80. However, a size of the throat 90 varies over time due to flexing, wear, and deformation of the tag holder 80, such that the flanges 87-89 with throat 90 becomes an unreliable tag holder structure. Further, the throat 90 positions the second tag at a location where the second tag is often knocked out of position and/or knocked completely off the tag holder 80, such that the arrangement is not always satisfactory. The tag holder 80 further includes a vertical front wall 91 supporting the opposing flange 88.

Figure 6:
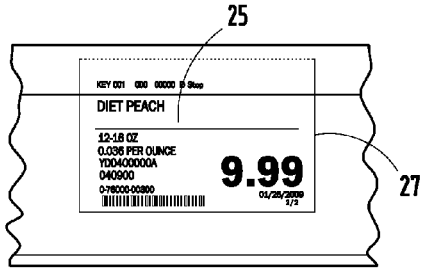
FIGS. 5-6 are enlarged side and front views of the tag in FIG. 1 as installed on an extruded tag holder attached to a front of a shelf but after a second section of the tag is torn off along a perforated line.
Figure 5:
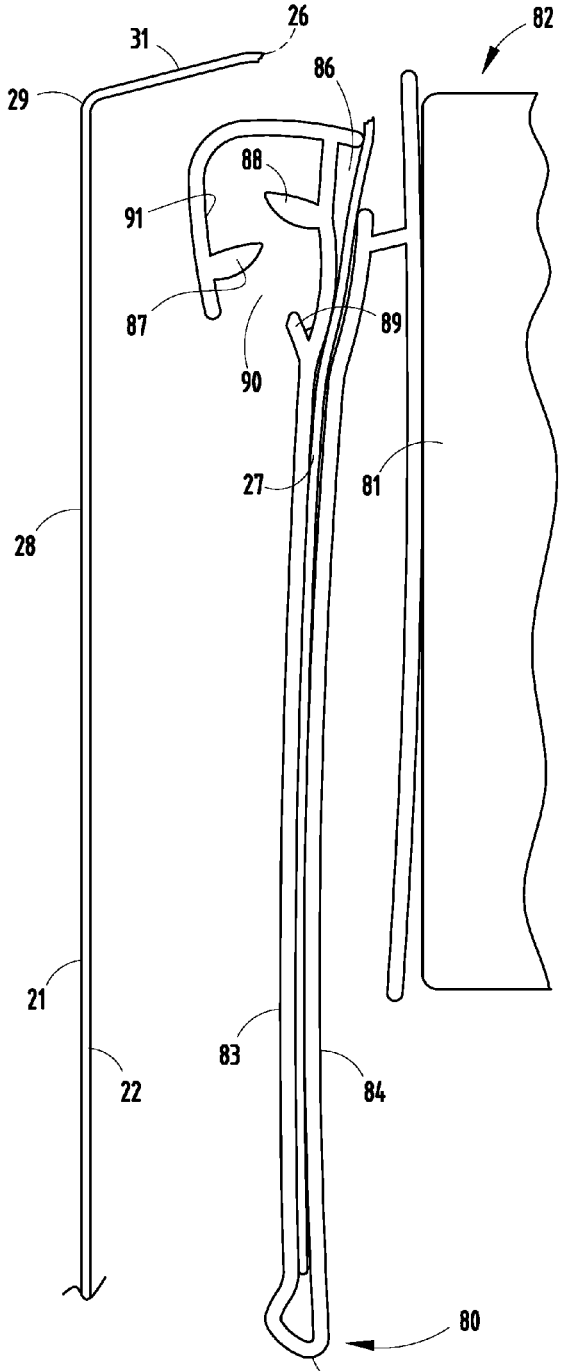

By folding the tag 20 along the perforated line 26 and along the pre-formed fold line 29, the strip region 31 supports the second section 28 parallel to and spaced from the remnant portion 30 by a distance equal to a distance from the pocket 86 to a front of the wall 91 of the tag holder 80. The information 23 is printed so that it is properly oriented to a customer when the second section 28 is held in front of the extruded tag holder 80. The information 25 is printed so that it is properly oriented to a customer when the remnant portion 30 is in the pocket 86, so that when the second section 28 is torn off along the perforated line 26 (see FIGS. 5-6), the information 25 becomes visible and is properly oriented. The information 24 is preferably a product picture (or large print) so that a tag-installing worker can easily see and place the tag 20 without having to read the information thereon. By using a picture, the installer does not have to be literate in the language of the tag. Notably, the information 24 is generally not visible by a customer since it faces away from a customer when the tag 20 is double-folded and placed in a tag holder 80. By this arrangement, the first section 27 forms the attachment structure.

Figure 7:
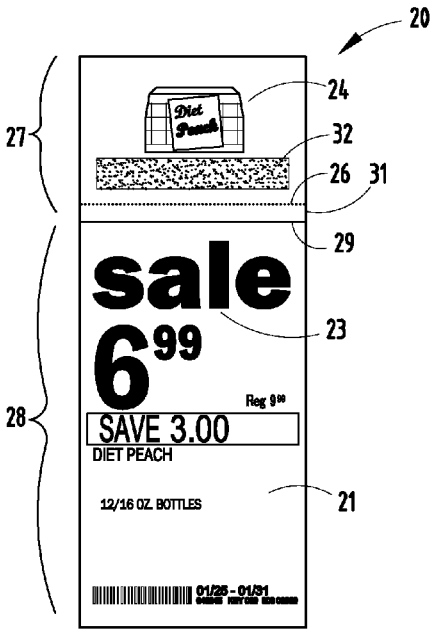
FIGS. 7-8 are front and rear views of the tag in FIG. 1 but modified to include adhesive.
Figure 8:
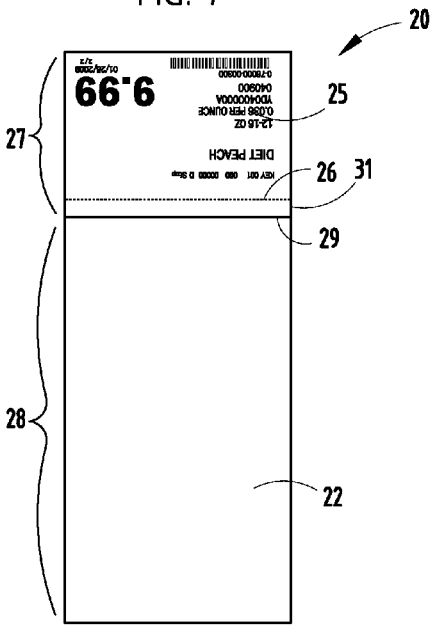

As noted above, the tag can optionally include adhesive 32 (FIG. 7). It is contemplated that the adhesive can be a continuous strip or one or more spots of adhesive material placed onto the first section 27 near the perforated line 26. The strip of adhesive 32 can be covered by release paper until ready for use. The strip of adhesive 32 is adapted to retain the tag 20 directly to a shelf front 81 without the need for a separate channel or extruded tag holder 80 being attached to the shelf. (See FIG. 9.)

It is contemplated that the present construction can be varied and still be within a scope of the present invention. For example, the illustrated perforated line 26 is a series of small holes forming a transverse line across the sheet, the holes being relatively small in size (to minimize their visibility) and arranged so that a clean line is formed when the second section 28 is torn from the first section 27. However, it is contemplated that the perforated line 26 can be slots, non-hole imperfections, and the like. Also, the illustrated sheet is about 2¼ inch wide and 5¾ inch long, with the perforated line at 1 7/16 inch and the fold line at 1-1 11/16 inch. Nonetheless, dimensions may vary and still be within a scope of the present invention. The illustrated sheet is made of stiff paper or polymeric sheet material that is sufficiently rigid yet bendable to hold its shape once folded and having a surface suitable to be printed on by a high quality digital press. The sheet is capable of taking and holding a bend, and can be perforated for easy tearing and separation. The illustrated information 23 includes typical details of a sale such as a name of the product, regular price, sale price, bar code, dates of sale, and is in color for maximum visual effect. It can also include a product picture if desired. The information 24 is a product picture. Notably, when double-folded and installed, the information 24 is not visible to a customer since it faces toward the shelf. However, this information greatly helps a worker installing the information tag 20 in a tag holder 80. By using a picture, there is no need for the worker to read the printed language. It is contemplated that the information 24 can include other items to help the worker, such as large print or other details to help. The information 25 is similar to the information 23, but of course information 25 provides details of the regular price along with product information.

As noted above, cost and quality of tags is important for competitive reasons and also since studies show that high quality pictures of the product and high quality color printing is important to maximize customer interest and likelihood of purchase. Further, the pricing-and-information tags must not only be very attractive, clear, and accurate, but also they should be provided on a just-in-time basis so that changes can be made as late in the purchasing process and pricing decision process as possible. As previously noted, a process and apparatus for providing competitive and highly-attractive price-and-information tags is disclosed in co-assigned application Ser. No. 11/612,821, filed Dec. 19, 2006, entitled METHOD OF PRINTING, DISTRIBUTING, AND PLACING PRICE INFORMATION. Notably, the digital press advantageously offers many advantages and characteristics that facilitate meeting the goals of quality, cost, and just-in-time delivery noted above. Thus, Applicant affirms that the process disclosed in application Ser. No. 11/612,821 is an excellent way to print the present tags.

Figure 10:
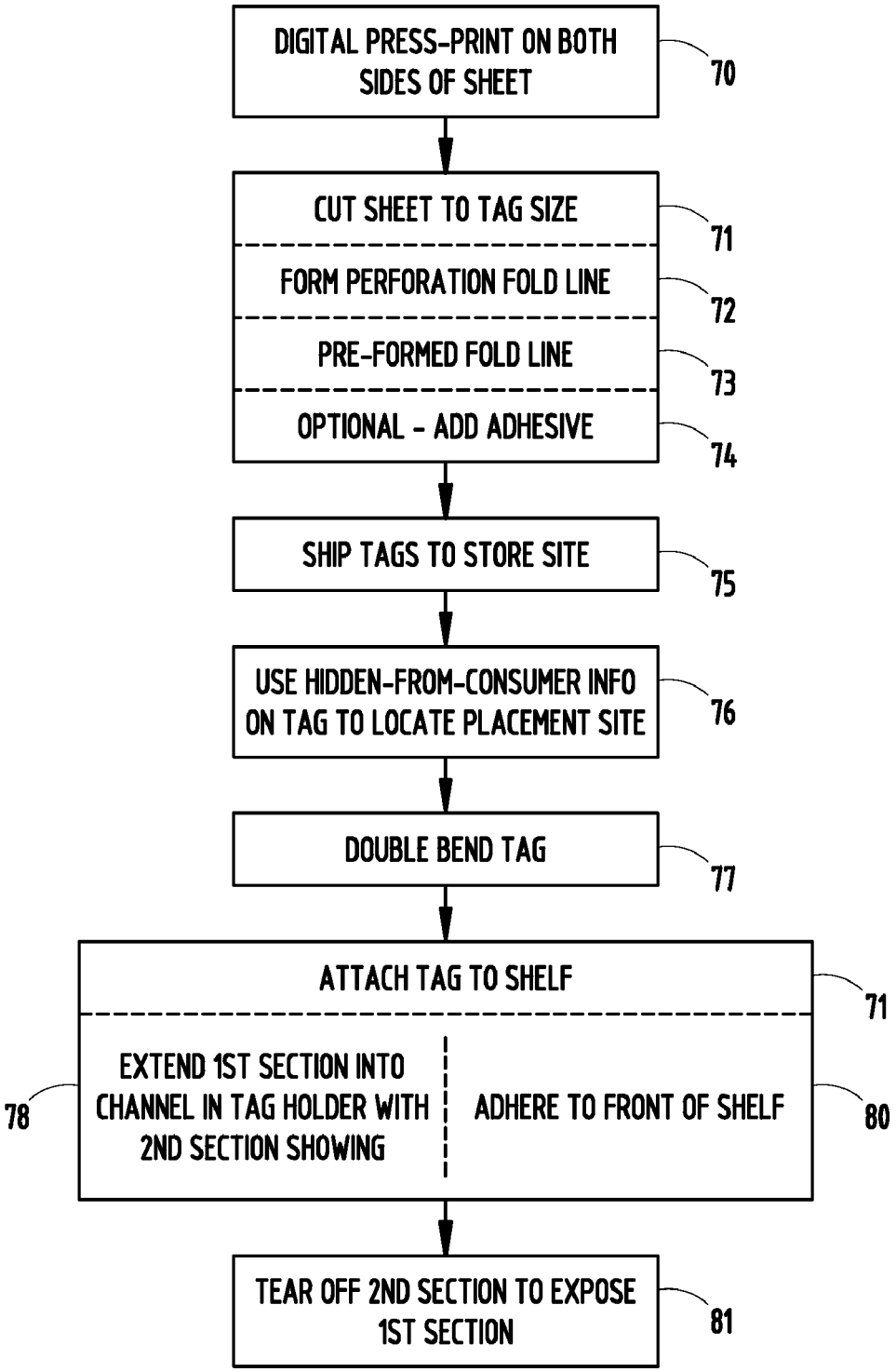
FIG. 10 is a flow chart showing a method of attaching a tag to a shelf and then tearing off a portion of the tag to reveal previously-hidden price and product information.

FIG. 10 is a flowchart showing methods related to the above. It is contemplated that all or part of the illustrated method may be used and still be within a scope of the present invention. The method includes printing price and product information on both sides of a sheet (step 70), preferably by a digital press. The sheet can be cut to the size of a tag (step 71) before or after forming a perforated line across the sheet to divide the sheet into first and second sections (step 72) and forming a pre-formed fold line spaced from the perforated line a selected distance (step 73). Adhesive can also be added (step 74) before or after cutting the sheet to a tag-sized shape. The tags are then shipped to the store site (step 75) where the hidden-from-customer information is used to locate their placement site on shelves (step 76). The tags are then double-folded (step 77) to form a first section with first information thereon hidden behind a second section with second information thereon, the first section being spaced from the second vertical section by a horizontal strip region. The method further includes attaching the sheet to a shelf (step 78) such as by attaching the tag to a shelf-supported tag holder (step 79) or by adhering the tag to a shelf (step 80) with the second information visible but the first information not visible since it is hidden by the second section. Later, the second section is torn off (step 81), exposing the second information. In one form, the step of attaching includes placing the first section downwardly into an upwardly-open pocket on the tag holder (step 79). In another form, the step of attaching includes adhering the first section to a front of a shelf (step 80).

To summarize, a price-and-information tag is provided that includes an elongated sheet having front and rear surfaces with product and price information printed on both the front and rear surfaces, and including attachment structure for releasably engaging a tag holder attached to the front of a product-display shelf. The price-and-information tag includes an elongated sheet having front and rear surfaces and first and second sections separated by a fold line, with product and price information printed on both the front and rear surfaces of the first section. As folded, the tag shows a first area of the information (such as information about a sale price). By tearing off a portion of the tag, a second area of the information is exposed (such as information about a regular price). This eliminates a need to replace the first tag in order to provide the new (regular price) information. By double-folding the tag, the first section can be extended into an upwardly-open pocket on the tag holder, with the second section spaced forward for extending vertically downwardly in front of the tag holder.

Also, a method of placing price-and-information tags comprises steps of providing an elongated sheet having front and rear surfaces with product and price information printed on both the front and rear surfaces, providing a tag holder on a shelf front, folding the sheet to form a first section with first information thereon hidden behind a second section with second information thereon, attaching the sheet to the tag holder with the first information visible but the second information not visible, and tearing off the first section to expose the second information.

Also, a method of placing price-and-information tags comprises steps of providing an elongated sheet having front and rear surfaces with product and price information printed on both the front and rear surfaces, double-folding the elongated sheet to form a first section separated from a second section by a strip region, and extending the first section into an upwardly-open pocket of a tag holder such that the product and price information on the second section is visible in front of the tag holder, with the product and price information of the first section hidden behind the second section.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A price-and-information system comprising, in combination:

a transparent tag holder defining an upwardly open pocket, the tag holder being adapted for attachment to a front of a display shelf; and a price-and-information tag including an elongated sheet having front and rear surfaces with product and price information printed on both the front and rear surfaces, and including attachment structure releasably engaging the upwardly open pocket of the tag holder with a portion of the product and price information on the front surface being outside of and in front of the pocket and visible, and the tag being folded so that the product and price information on the rear surface faces forward but is hidden by a part of the sheet.

2. The price-and-information system defined in claim 1, wherein the sheet includes first and second sections, the attachment structure being another part of the first section, the first and second sections being separated by at least one fold line.

3. The price-and-information system defined in claim 2, wherein the at least one fold line includes a perforated line.

4. The price-and-information system defined in claim 3, wherein the elongated sheet defines an elongated direction, and the perforated line extends transversely to the elongated direction.

5. The price-and-information system defined in claim 1, wherein some of the product and price information is printed on both the front and rear surfaces of the first section.

6. The price-and-information system defined in claim 5, wherein the product and price information that is printed on the front surface of the first section includes a product picture.

7. The price-and-information system defined in claim 5, wherein the product and price information printed on the front surface of the second section is for a discounted "sale" price for specific product, and wherein the product and price information printed on the rear surface of the first section includes a "non-sale" price for the specific product.

8. The price-and-information system defined in claim 1, wherein the product and price information is printed by a digital press with high clarity and in multi-color.

9. The price-and-information system defined in claim 1, including adhesive on the sheet for secondary attachment to shelf without requiring a tag holder.

10. The price-and-information system defined in claim 1, wherein the sheet includes first and second sections separated by a perforated line, whereby one of the first and second sections can be removed by tearing the sheet along the perforated line to expose the hidden part of the sheet.

11. The price-and-information system defined in claim 1, wherein the sheet includes adhesive for attaching the sheet to a shelf separate from the tag holder, the adhesive being positioned to remain attached to the shelf when the portion of the product and price information on the front surface that is outside of and in front of the pocket is removed.

12. In a price-and-information system including a transparent tag holder defining an upwardly open pocket for receiving a price-and-information tag, the tag holder being adapted for attachment to a front of a display shelf, an improvement in the tag comprising:

an elongated sheet having front and rear surfaces with product and price information printed on both the front and rear surfaces, and including attachment structure for releasably engaging the upwardly open pocket of the tag holder with a portion of the product and price information on the front surface being visible and the sheet being folded so that the product and price information on the rear surface faces forward but is hidden by a part of the sheet;

wherein the sheet includes first and second sections, the attachment structure being another part of the first section, the first and second sections being separated by at least one fold line;

wherein the at least one fold line includes a perforated line;

wherein the elongated sheet defines an elongated direction, and the perforated line extends transversely to the elongated direction; and wherein the at least one fold line includes a pre-formed fold line spaced from the perforated line.

13. In a price-and-information system including a transparent tag holder defining an upwardly open pocket for receiving a price-and-information tag, the tag holder being adapted for attachment to a front of a display shelf, an improvement in the tag comprising:

an elongated sheet having front and rear surfaces with product and price information printed on both the front and rear surfaces, and including attachment structure for releasably engaging the upwardly open pocket of the tag holder with a portion of the product and price information on the front surface being visible and the sheet being folded so that the product and price information on the rear surface faces forward but is hidden by a part of the sheet;

wherein the sheet includes first and second sections separated by a first fold line, and further includes a perforated line that forms a second fold line, the strip region between the perforated line and the pre-formed fold line having a dimension selected and adapted to match a front-to-rear dimension between a rear pocket and a front surface of an extruded tag holder, such that when double-folded, the first section fits into the pocket with the second section extending generally vertically down the tag holder with the strip region spacing the second section forward of the first section.

14. The price-and-information system defined in claim 13, wherein the second section includes a pre-formed fold line dividing the second section into a strip region and a front-hanging region, the first section being sufficient in length to extend at least a half inch into an upwardly-open rear pocket of an extruded tag holder with the strip region spacing the second section forward for draping downward across a front of the tag holder.

15. A price-and-information system comprising, in combination:

a price-and-information tag holder; and an elongated sheet having front and rear surfaces, and also having first and second sections separated by at least one folded tearable line, with product and price information printed on both the front and rear surfaces of the first section, and where the sheet is folded so that a portion of the sheet covers a portion of the information but can be torn along the tearable line to expose the covered portion of the information.

16. The price-and-information tag defined in claim 15, wherein the product and price information is printed by a digital press with high clarity and in multi-color.

17. The price-and-information system defined in claim 15, wherein the sheet includes adhesive for attaching the sheet to a shelf separate from the tag holder.

18. A price-and-information tag comprising:

an elongated sheet having front and rear surfaces, and also having first and second sections separated by a fold line, with product and price information printed on both the front and rear surfaces of the first section, and where the sheet is folded so that a portion of the sheet covers a portion of the information; the sheet including a perforated line spaced from and extending parallel the fold line.

19. A method of placing price-and-information tags, comprising steps of:

providing an elongated sheet having front and rear surfaces with product and price information printed on both the front and rear surfaces;

providing a tag holder on a shelf front;

folding the sheet to form a first section with first information thereon hidden behind a second section with second information thereon;

attaching the sheet to the tag holder with the second information visible but the first information not visible; and tearing off the second section to expose the first information.

20. The method defined in claim 19, including providing a perforated line separating the first and second sections, and wherein the step of tearing off includes tearing along the perforated line.

21. A method of placing price-and-information tags, comprising steps of:

providing an elongated sheet having front and rear surfaces with product and price information printed on both the front and rear surfaces;

double-folding the elongated sheet to form a first vertical section separated from a second vertical section by a horizontal strip region;

extending the first vertical section into an upwardly-open pocket of a tag holder such that the sheet is securely held by the tag holder with the product and price information on the second vertical section being visible in front of the tag holder, with the product and price information of the first vertical section being hidden behind the second vertical section.

22. The method defined in claim 21, including ripping off the second section to expose the price and product information on the first section.

23. The method defined in claim 22, including providing a perforated line, and wherein the step of ripping is along the perforated line.

* * * * *